US012221956B2

(12) United States Patent
Imai

(10) Patent No.: US 12,221,956 B2
(45) Date of Patent: Feb. 11, 2025

(54) TUBE PUMP

(71) Applicant: Surpass Industry Co., Ltd., Saitama (JP)

(72) Inventor: Hiroshi Imai, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 0 days.

(21) Appl. No.: 17/152,134

(22) Filed: Jan. 19, 2021

(65) Prior Publication Data

US 2021/0239108 A1 Aug. 5, 2021

(30) Foreign Application Priority Data

Jan. 31, 2020 (JP) ..... 2020-015072

(51) Int. Cl.
*F04B 43/09* (2006.01)
*F04B 11/00* (2006.01)
(Continued)

(52) U.S. Cl.
CPC ..... *F04B 43/09* (2013.01); *F04B 11/0091* (2013.01); *F04B 43/1253* (2013.01); *F04B 53/16* (2013.01); *F04B 2201/08* (2013.01)

(58) Field of Classification Search
CPC .. F04B 43/1253; F04B 43/1292; F04B 43/08; F04B 43/084; F04B 43/12; F04B 45/06;
(Continued)

(56) References Cited

U.S. PATENT DOCUMENTS 3,649,138 A 3/1972 Clay et al.
3,726,613 A 4/1973 Von Casimir
(Continued)

FOREIGN PATENT DOCUMENTS

DE 20109803 10/2002
EP 1942964 7/2008
(Continued)

OTHER PUBLICATIONS

Extended European Search Report for Application No. EP 21151557.2, entitled: "Tube Pump", dated Mar. 29, 2021.
(Continued)

*Primary Examiner* — Philip E Stimpert
*Assistant Examiner* — Dnyanesh G Kasture
(74) *Attorney, Agent, or Firm* — Hamilton, Brook, Smith & Reynolds, P.C.

(57) ABSTRACT

Provided is a tube pump including: a housing unit that has an inner peripheral surface, which is formed in an arc shape around an axis, along which a tube with flexibility is disposed, and that is opened toward one end side along the axis; a pair of roller units that are accommodated in the housing unit and rotate about the axis in a state in which the tube is blocked; a pair of drive units that cause each of the pair of roller units to rotate about the axis in the same direction; and a cover member that is disposed in the housing unit such that the cover member covers the pair of roller units and provides an annular opening region into which the tube is able to be inserted toward the inner peripheral surface.

5 Claims, 10 Drawing Sheets

(51) Int. Cl.
*F04B 43/12* (2006.01)
*F04B 53/16* (2006.01)

(58) Field of Classification Search
CPC ..... F04B 45/08; F04B 43/09; F04B 11/0091; F04B 2201/08; F04B 43/1269; F04B 43/1276; F04B 43/1284; F04B 53/16
See application file for complete search history.

(56) References Cited

U.S. PATENT DOCUMENTS

| | | | | |
|---|---|---|---|---|
| 3,756,752 | A * | 9/1973 | Stenner | F04B 43/1253 417/477.1 |
| 3,826,593 | A | 7/1974 | Von Casimir | |
| 3,938,909 | A | 2/1976 | Willock | |
| 3,985,019 | A | 10/1976 | Boehme et al. | |
| 4,142,845 | A * | 3/1979 | Lepp | A61M 1/30 251/9 |
| 4,496,295 | A | 1/1985 | King | |
| 4,705,464 | A * | 11/1987 | Arimond | F04B 43/1276 417/477.7 |
| 5,388,972 | A | 2/1995 | Calhoun et al. | |
| 5,533,877 | A | 7/1996 | Friedmann et al. | |
| 5,586,872 | A | 12/1996 | Skobelev et al. | |
| 5,640,181 | A | 6/1997 | Uchida et al. | |
| 5,657,000 | A * | 8/1997 | Ellingboe | F04B 49/06 417/63 |
| 5,971,726 | A | 10/1999 | Yoshida et al. | |
| 6,264,034 | B1 | 7/2001 | Yamazaki | |
| 7,645,127 | B2 | 1/2010 | Hagen et al. | |
| 8,047,819 | B2 | 11/2011 | Lawrence et al. | |
| 10,082,136 | B2 | 9/2018 | Imai et al. | |
| 10,465,673 | B2 | 11/2019 | Ackermann et al. | |
| 10,528,064 | B2 | 1/2020 | Imai et al. | |
| 10,746,168 | B2 | 8/2020 | Imai et al. | |
| 11,542,937 | B2 | 1/2023 | Imai | |
| 12,018,670 | B2 | 6/2024 | Imai | |
| 12,025,117 | B2 | 7/2024 | Imai | |
| 2004/0057856 | A1 | 3/2004 | Saxer et al. | |
| 2004/0217236 | A1 | 11/2004 | Shibuya | |
| 2005/0019185 | A1 | 1/2005 | Otis, Jr. | |
| 2005/0025647 | A1* | 2/2005 | Ortega | F04B 43/1253 417/477.1 |
| 2006/0245964 | A1 | 11/2006 | Koslov | |
| 2008/0213113 | A1 | 9/2008 | Lawrence et al. | |
| 2009/0053084 | A1* | 2/2009 | Klein | A61M 5/14232 417/477.1 |
| 2011/0033318 | A1 | 2/2011 | Ramirez, Jr. et al. | |
| 2012/0195777 | A1* | 8/2012 | Stejskal | A61M 60/441 417/477.3 |
| 2013/0072871 | A1 | 3/2013 | Ozturk | |
| 2013/0280104 | A1 | 10/2013 | Heide et al. | |
| 2013/0315763 | A1 | 11/2013 | Neoh et al. | |
| 2015/0159642 | A1 | 6/2015 | Sasa et al. | |
| 2015/0240802 | A1 | 8/2015 | Guthrie et al. | |
| 2015/0330385 | A1 | 11/2015 | Lofstrom et al. | |
| 2016/0245271 | A1 | 8/2016 | Schaefer et al. | |
| 2016/0265519 | A1 | 9/2016 | Igarashi | |
| 2017/0028117 | A1* | 2/2017 | Mochizuki | F04B 43/1253 |
| 2017/0051735 | A1 | 2/2017 | Gaskill-Fox et al. | |
| 2017/0096995 | A1* | 4/2017 | Imai | F04B 43/1276 |
| 2018/0066646 | A1 | 3/2018 | Himmelmann | |
| 2018/0074525 | A1 | 3/2018 | Imai et al. | |
| 2018/0100605 | A1 | 4/2018 | Robinault et al. | |
| 2018/0128266 | A1 | 5/2018 | Gaskill-Fox et al. | |
| 2018/0230987 | A1* | 8/2018 | Imai | F04B 43/0072 |
| 2019/0017500 | A1* | 1/2019 | Minatodani | F16D 1/06 |
| 2019/0120408 | A1 | 4/2019 | Milner | |
| 2019/0136853 | A1 | 5/2019 | Bach | |
| 2019/0234394 | A1 | 8/2019 | Gledhill, III et al. | |
| 2019/0285064 | A1 | 9/2019 | Imai et al. | |
| 2020/0038581 | A1 | 2/2020 | Bowman et al. | |
| 2020/0208624 | A1* | 7/2020 | Wang | A61M 5/44 |
| 2020/0263682 | A1 | 8/2020 | Imai | |
| 2021/0037239 | A1 | 12/2021 | Imai | |
| 2021/0372392 | A1 | 12/2021 | Imai | |
| 2021/0372393 | A1 | 12/2021 | Imai | |

FOREIGN PATENT DOCUMENTS

| | | | |
|---|---|---|---|
| EP | 2397695 | | 12/2011 |
| EP | 3543532 | | 9/2019 |
| JP | S52112805 | | 9/1977 |
| JP | S56129790 | | 10/1981 |
| JP | 57-026690 | U | 2/1982 |
| JP | S5773882 | | 5/1982 |
| JP | 62-126585 | U | 8/1987 |
| JP | 04-080545 | U | 7/1992 |
| JP | 04-100086 | U | 8/1992 |
| JP | H05-263765 | | 10/1993 |
| JP | 2000-205201 | | 7/2000 |
| JP | 2003-021050 | A | 1/2003 |
| JP | 2008-002388 | A | 1/2008 |
| JP | 2008308994 | | 12/2008 |
| JP | 2013-231413 | A | 11/2013 |
| JP | 2013-240135 | A | 11/2013 |
| JP | 2014214614 | | 11/2014 |
| JP | 2016169620 | | 9/2016 |
| JP | 2017062247 | | 3/2017 |
| JP | 2017067054 | | 4/2017 |
| JP | 2018-044488 | A | 3/2018 |
| JP | 2018131946 | | 8/2018 |
| WO | 2007/038364 | A2 | 4/2007 |

OTHER PUBLICATIONS

European Extended Search Report mailed Nov. 27, 2017 for European Application No. 17190606.8-1616, entitled "Tube Pump System and Method for Controlling the Tube Pump System.".

European Search Report for European Application No. 19162820.5, entitled Tube Pump System and Method for Controlling the Tube Pump System, dated Jul. 15, 2019.

Extended European Search Report for Application No. 21055305.4, entitled: Tube Pump System and Method for Controlling the Tube Pump System, dated May 8, 2020.

U.S. Non-Final Office Action for U.S. Appl. No. 16/295,319, entitled Tube Pump System and Method for Controlling the Tube Pump System, dated Sep. 11, 2020.

European Search Report received in EP Application No. 21174877.7 entitled, "Tube Pump System," mailed Sep. 24, 2021.

European Search Report received in EP Application No. 21175039.3 entitled, "Tube Holding Member and Tube Pump," mailed Nov. 25, 2021.

Notice of Allowance for U.S. Appl. No. 17/325,702, filed May 20, 2021, entitled "Tube Pump System," dated Nov. 7, 2023.

* cited by examiner

TUBE PUMP

RELATED APPLICATION

This application claims priority under 35 U.S.C. § 119 or 365 to Japanese Application No. 2020-015072, filed Jan. 31, 2020. The entire teachings of the above application are incorporated herein by reference.

BACKGROUND

1. Technical Field

The present disclosure relates to a tube pump.

In the related art, a tube pump that pressure-feeds a liquid in a tube with flexibility by a plurality of rollers intermittently squeezing the tube is known (see Japanese Unexamined Patent Application, Publication No. 2018-44488, for example). Since the tube pump intermittently pressure-feeds the liquid, pulsation (a state in which an increase and a decrease in flow amount are repeated) is caused in the pressure-fed liquid.

Japanese Unexamined Patent Application, Publication No. 2018-44488 discloses a trouble that pulsation occurs due to a phenomenon that the liquid is drawn from a flow path located downstream to the side of the tube pump when the tube squeezed by the rollers returns to the original shape. Japanese Unexamined Patent Application, Publication No. 2018-44488 discloses that in order to curb such pulsation, the pressure of the liquid in the tube blocked due to contact with a pair of roller units is boosted when one of the pair of roller units passes through a separation position at which the roller units are separated from the tube. According to Japanese Unexamined Patent Application, Publication No. 2018-44488, it is possible to curb the phenomenon that the liquid is drawn to the side of the tube pump by boosting the pressure of the liquid in the tube.

The tube pump disclosed in Japanese Unexamined Patent Application, Publication No. 2018-44488 has a structure in which both a first roller unit and a second roller unit that rotate about an axis in contact with a tube can independently rotate about the axis. Therefore, the relative rotation position of the second roller unit around the axis with respect to the first roller unit varies, and a state in which a rotation angle between the first roller unit and the second roller unit becomes narrow and a state in which the rotation angle becomes wide alternately occur.

If an operator accidentally touches the vicinity of the first roller unit and the second roller unit with hands when both the first roller unit and the second roller unit rotate about the axis, there is a probability that fingers of the operator get caught between the first roller unit and the second roller unit. On the other hand, if the first roller unit and the second roller unit are covered in order to prevent the operator from touching the vicinity thereof, it is not possible to easily replace the tube.

The present disclosure was made in view of such circumstances, and an object thereof is to provide a tube pump capable of causing each of a pair of roller units that come into contact with a tube to independently rotate about an axis, preventing fingers of an operator from getting caught between the pair of roller units, and allowing the operator to easily replace the tube.

SUMMARY

The present disclosure employs the following means to solve the aforementioned problem.

A tube pump according to an aspect of the present disclosure includes: a housing unit that has an inner peripheral surface, which is formed in an arc shape around an axis, along which a tube with flexibility is disposed, and that is opened toward one end side along the axis; a pair of roller units that are accommodated in the housing unit and rotate about the axis in a state in which the tube is blocked; a pair of drive units that cause each of the pair of roller units to rotate about the axis in the same direction; and a cover member that is disposed in the housing unit such that the cover member provides an annular opening region into which the tube is able to be inserted toward the inner peripheral surface.

Since the tube pump of according to an aspect of the present disclosure includes the pair of roller units and the pair of drive units that cause each of the pair of roller units to rotate about the axis in the same direction, it is possible to cause the pair of roller units that rotate in contact with the tube held around the axis in the arc shape by the housing unit to independently rotate about the axis. Also, according to the tube pump of an aspect of the present disclosure, the cover member is disposed in the housing unit such that the housing unit provides the annular opening region into which the tube is able to be inserted toward the inner peripheral surface. Therefore, fingers of an operator are prevented from getting caught between the pair of roller units. Also, the tube can be inserted from the opening region toward the inner peripheral surface of the housing unit, and it is thus possible for the operator to easily replace the tube.

In the tube pump according to an aspect of the present disclosure, the pair of roller units may have a pair of rollers that come into contact with the tube, a pair of roller support members that are coupled to the pair of drive units and rotate about the axis while supporting the pair of rollers, and a pair of roller shafts, which have both end portions supported by the roller support members, to which the rollers are rotatably attached, and the cover member may be disposed in the housing unit such that the cover member covers the pair of roller shafts.

According to the tube pump with the configuration, the cover member is disposed in the housing unit such that the cover member covers the pair of roller shafts. Even if the pair of rollers attached to the pair of roller shafts approach or come into contact with each other in a rotation direction around the axis, the pair of rollers approach or come into contact with each other in a region covered with the cover member. It is thus possible to prevent a trouble that fingers of the operator get caught due to the approaching or the contact of the pair of rollers.

In the tube pump according to an aspect of the present disclosure, the cover member may be formed such that rotation positions of the pair of roller units around the axis are visually recognizable.

According to the tube pump with the configuration, the rotation positions of the pair of roller units around the axis are visually recognizable regardless of the disposition of the cover member, and it is thus possible for the operator to easily find a trouble that a foreign matter gets caught between the pair of roller units and abnormality in operations of the pair of roller units. The cover member is preferably formed of a light transmitting material. Also, a plurality of notch portions with a narrower width than an opening width of the opening region, for example, are preferably formed in the cover member.

In the tube pump according to an aspect of the present disclosure, the housing unit may include a recessed part that accommodates the pair of roller units, the tube pump may further include: a lid unit that is able to switch between a closed state in which an entire region of the recessed part is covered and an opened state in which the lid unit is separated from the recessed part; a detection unit that detects the opened and closed states of the lid unit; and a control unit that controls each of the pair of drive units, and the control unit may perform control such that the pair of drive units are stopped in a case in which the detection unit detects that the lid unit is in the opened state.

According to the tube pump with the configuration, the lid unit covers the entire region of the recessed part in the closed state, and it is thus possible to reliably prevent the operator from accidentally touching the vicinity of the pair of roller units with hands and to prevent a trouble that fingers get caught due to the accidental touch. Also, since the pair of drive units are stopped in a case in which the detection unit detects that the lid unit is in the opened state, the pair of roller units do not rotate about the axis in a state in which the operator can touch the vicinity of the pair of roller units. It is thus possible to prevent the fingers of the operator from getting caught between the pair of roller units.

In the tube pump with the aforementioned configuration, the control unit may be able to execute a first control mode in which the pair of roller units are caused to rotate in a same direction to eject a fluid in the tube and a second control mode in which a rotation angle of each of the pair of roller units is fixed such that the pair of roller units do not come into contact with the tube.

Both the pair of roller units can be disposed at retreating positions at which the pair of roller units do not come into contact with the tube, by the control unit executing the second control mode. It is possible to easily replace the tube in use with another tube by the pair of roller units being disposed at the retreating positions.

According to the present disclosure, it is possible to provide a tube pump capable of causing each of the pair of the roller units that come into contact with the tube to independently rotate about the axis, preventing fingers of an operator from getting caught between the pair of roller units, and allowing the operator to easily replace the tube.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The teachings of all patents, published applications and references cited herein are incorporated by reference in their entirety.

Figure 1:
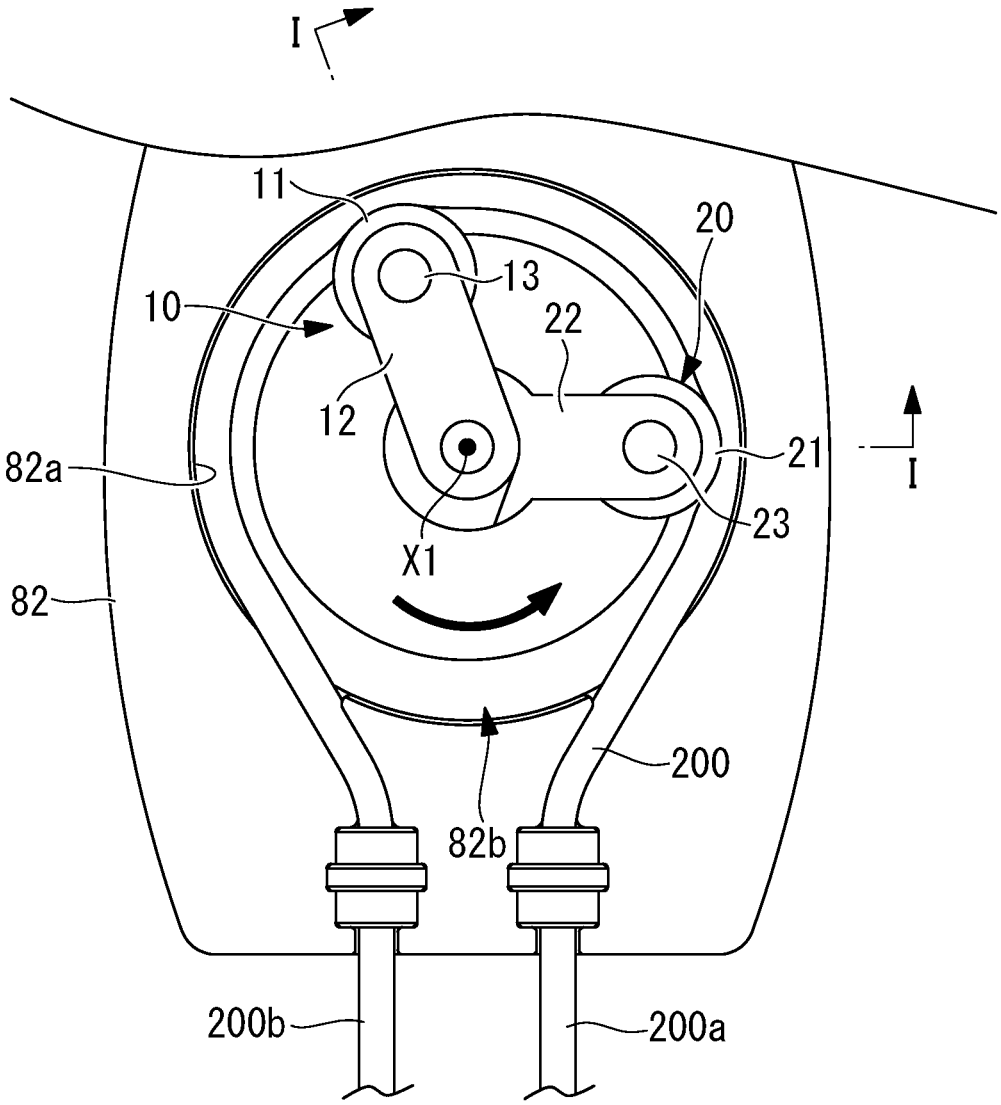
FIG. 1 is a plan view illustrating an embodiment of a tube pump.
Figure 2:
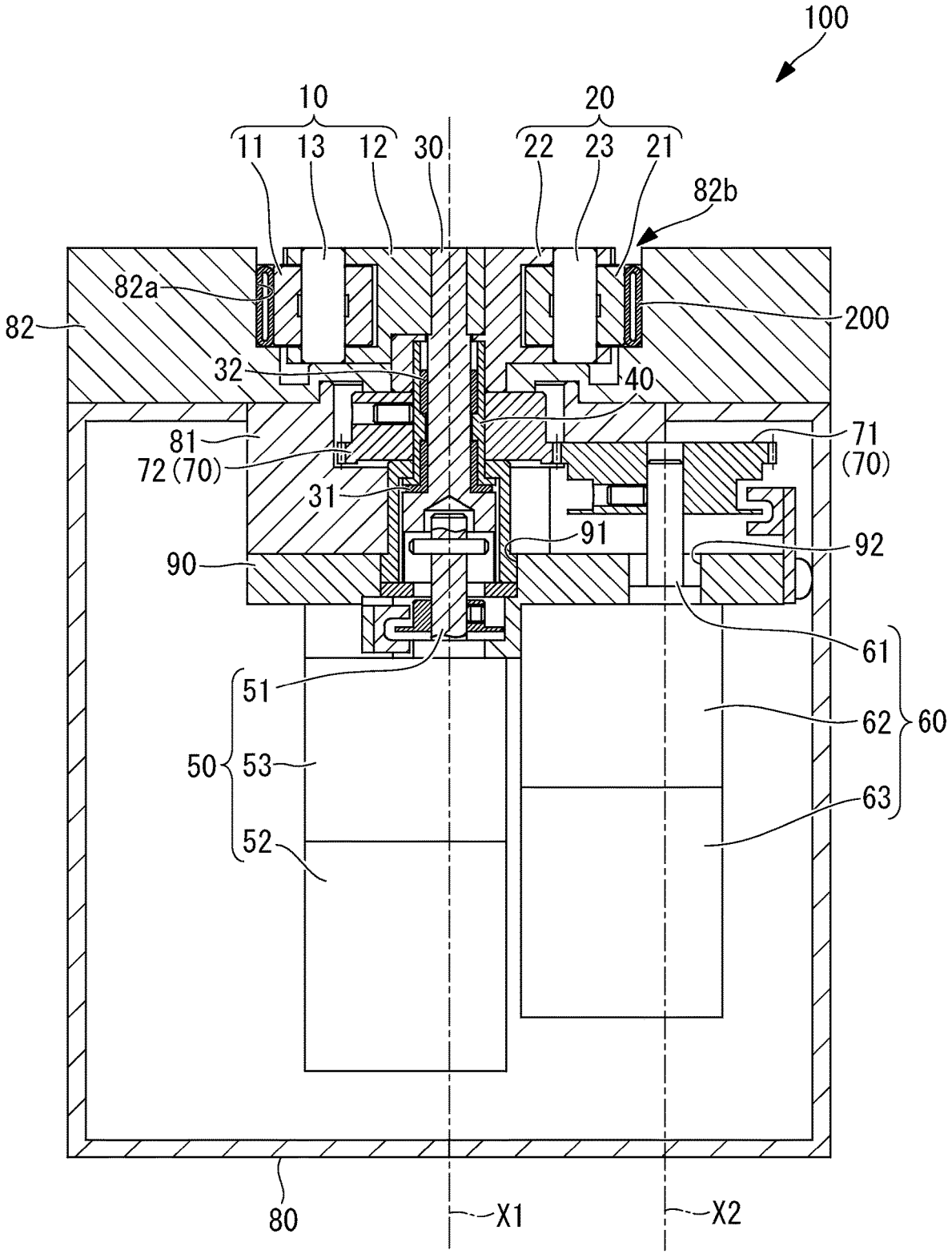
FIG. 2 is a longitudinal cross-sectional arrow view along I-I of the tube pump illustrated in FIG. 1.
Figure 5:
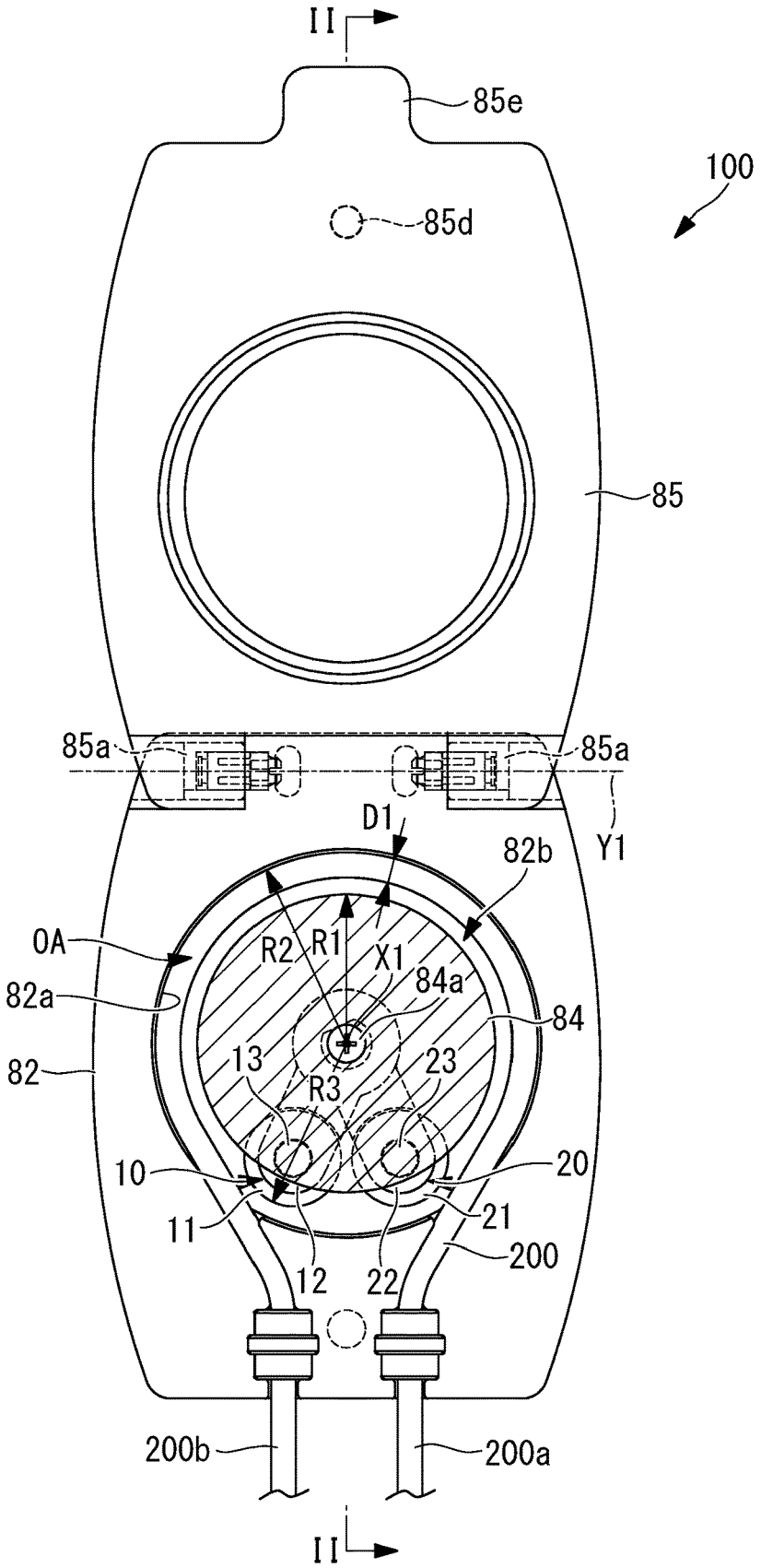
FIG. 5 is a plan view illustrating an embodiment of a tube pump with a lid unit in an opened state.
Figure 6:
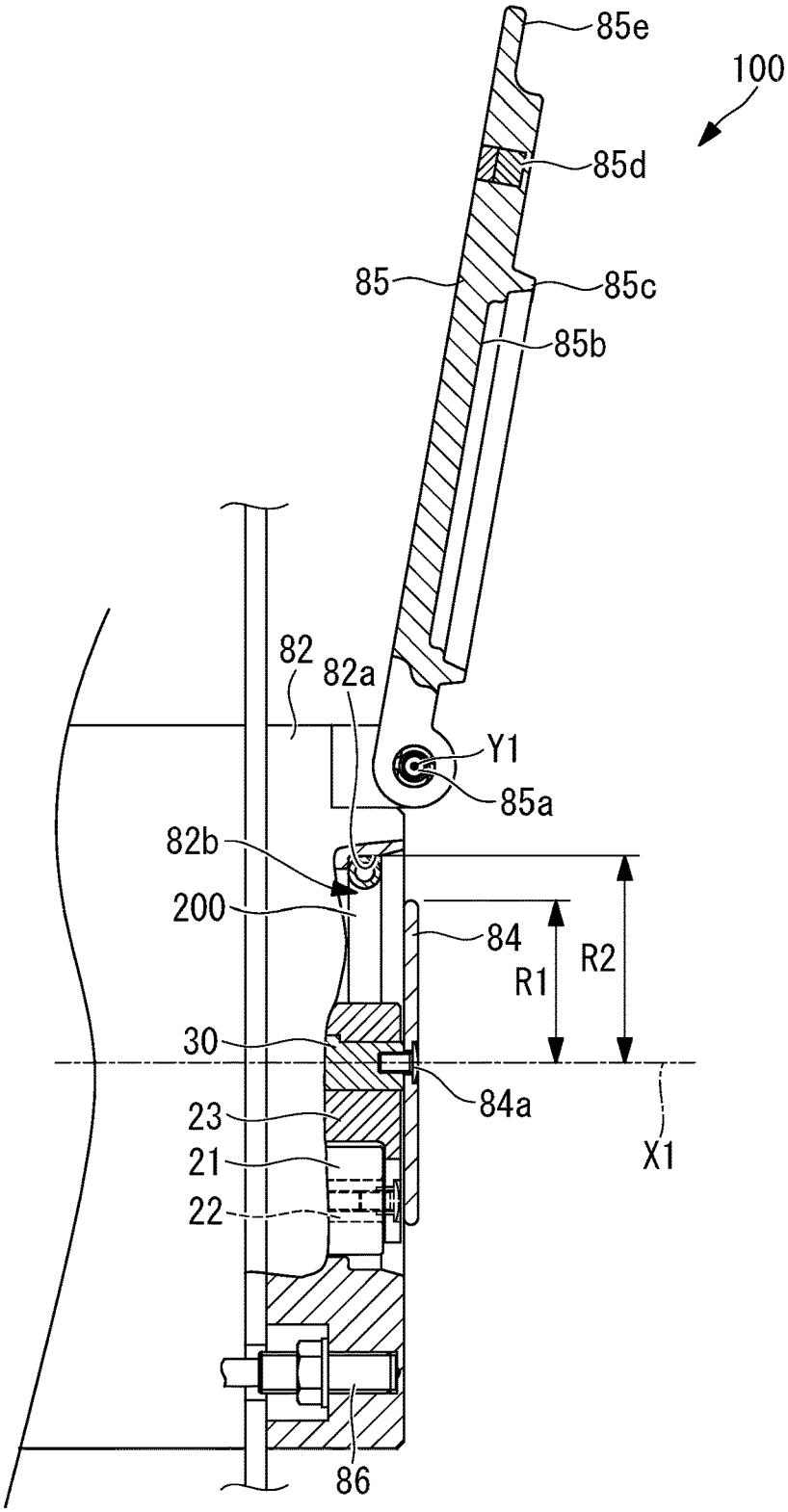
FIG. 6 is a cross-sectional arrow view along II-II of the tube pump illustrated in FIG. 5.
Figure 7:
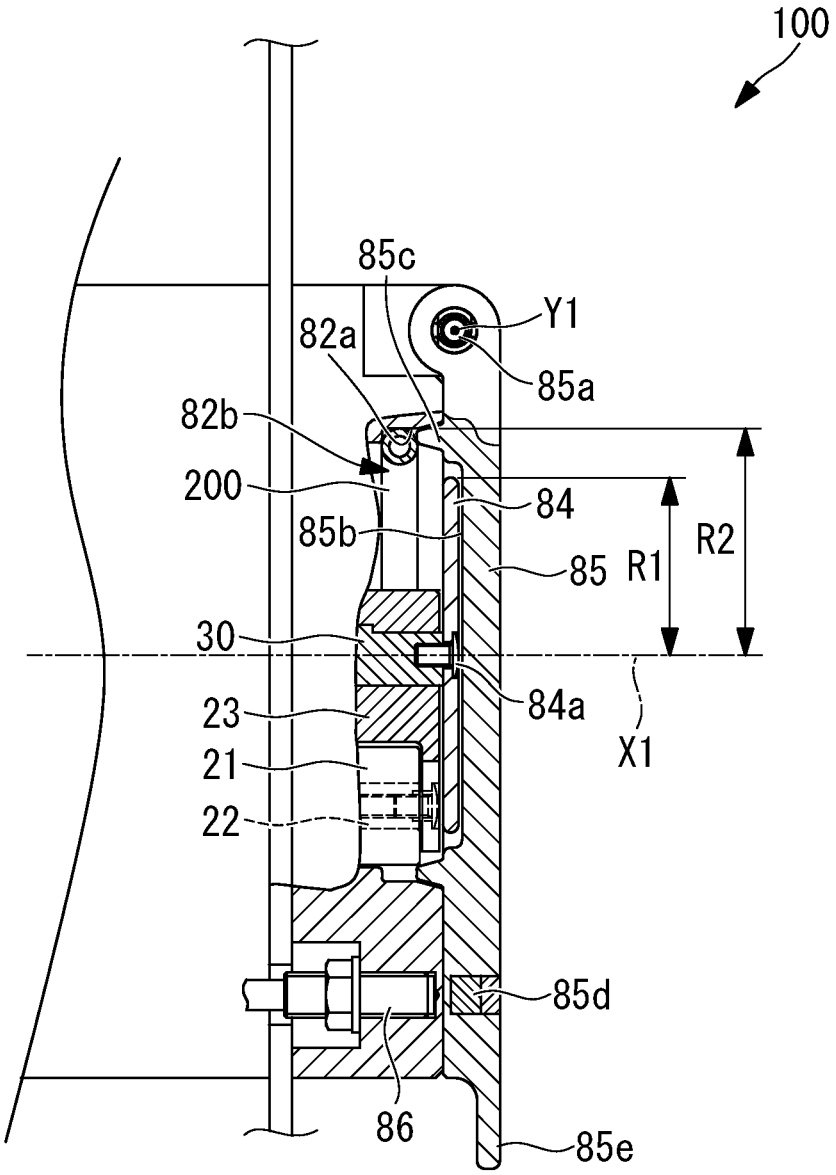
FIG. 7 is a cross-sectional arrow view along II-II illustrating an embodiment of the tube pump with the lid unit in a closed state.

Hereinafter, a tube pump (peristaltic pump) 100 according to an embodiment of the present disclosure will be described with reference to drawings. FIG. 1 is a plan view illustrating an embodiment of the tube pump 100. FIG. 2 is a longitudinal cross-sectional arrow view along I-I of the tube pump 100 illustrated in FIG. 1. In FIGS. 1 and 2, illustration of a cover member 84 and a lid unit 85 illustrated in FIGS. 5 to 7 is omitted.

The tube pump 100 according to the present embodiment illustrated in FIG. 1 is a device that ejects a fluid, which has flowed from a flowing-in side 200*a* and is stored in a tube 200, to a flowing-out side by causing a first roller unit 10 and a second roller unit 20 to rotate about an axis X1 (first axis) in the same direction.

As illustrated in the plan view of FIG. 1, the tube 200 is disposed in an arc shape around the axis X1 in the tube pump 100 along an inner peripheral surface 82*a* of a housing unit 82 that accommodates the first roller unit 10 and the second roller unit 20. The inner peripheral surface 82*a* is a surface, which is formed in an arc shape around the axis X1, along which the tube 200 is disposed. The housing unit 82 has a recessed part 82*b* that is opened toward one end side along the axis X1 and accommodates the first roller unit 10 and the second roller unit 20.

As shown in FIG. 1, the first roller unit 10 and the second roller unit 20 housed in the housing unit 82 rotate around the axis X1 along a counter-clockwise rotation direction (a direction shown by an arrow in FIG. 1) while being in contact with the tube 200.

As shown in FIG. 2, the tube pump 100 of the embodiment includes: the first roller unit 10 and the second roller unit 20 that rotate around the axis X1 while being in a state in which the tube 200 is blocked; a drive shaft 30 that is arranged on the axis X1 and is coupled to the first roller unit 10; a drive cylinder 40 that is coupled to the second roller unit 20; a first drive unit 50 that transmits a drive force to the drive shaft 30; a second drive unit 60; and a transmission mechanism 70 that transmits a drive force of the second drive unit 60 to the drive cylinder 40.

The first roller unit 10 has: a first roller 11 that rotates around an axis parallel to the axis X1 while being in contact with the tube 200; a first roller support member 12 coupled to the drive shaft 30 so as to integrally rotate around the axis X1; and a first roller shaft 13 both ends of which are supported by the first roller support member 12, and to which the first roller 11 is rotatably attached.

The first drive unit 50 causes the first roller unit 10 to rotate about the axis X1 in a counter-clockwise rotation direction. The first roller support member 12 is coupled to the first drive unit 50 and rotates about the axis in the counter-clockwise direction while supporting the first roller 11.

The second roller unit 20 has: a second roller 21 that rotates around an axis parallel to the axis X1 while being in contact with the tube 200; a second roller support member 22 coupled to the drive cylinder 40 so as to integrally rotate around the axis X1; and a second roller shaft 23 both ends of which are supported by the second roller support member 22, and to which the second roller 21 is rotatably attached.

The second drive unit 60 causes the second roller unit 20 to rotate about the axis X1 in a counter-clockwise rotation direction. The second roller support member 22 is coupled to the second drive unit 60 and rotates about the axis in the counter-clockwise direction while supporting the second roller 21.

As shown in FIG. 2, the first drive unit 50 and the second drive unit 60 are housed inside a casing 80 (a housing member). A gear housing unit 81 for housing the transmission mechanism 70, and a support member 90 that supports the first drive unit 50 and the second drive unit 60 are attached to an inside of the casing 80. In addition, the housing unit 82 for housing the first roller unit 10 and the second roller unit 20 is attached to an upper part of the casing 80.

A first through hole 91 that extends along the axis X1 and a second through hole 92 that extends along an axis X2 are formed in the support member 90. The first drive unit 50 is attached to the support member 90 by a fastening bolt (illustration is omitted) in a state where a first drive shaft 51 is inserted into the first through hole 91 formed in the support member 90. Similarly, the second drive unit 60 is attached to the support member 90 by a fastening bolt (illustration is omitted) in a state where a second drive shaft 61 is inserted into the second through hole 92 formed in the support member 90. As described above, each of the first drive unit 50 and the second drive unit 60 is attached to the support member 90, which is the integrally formed member.

Figure 3:
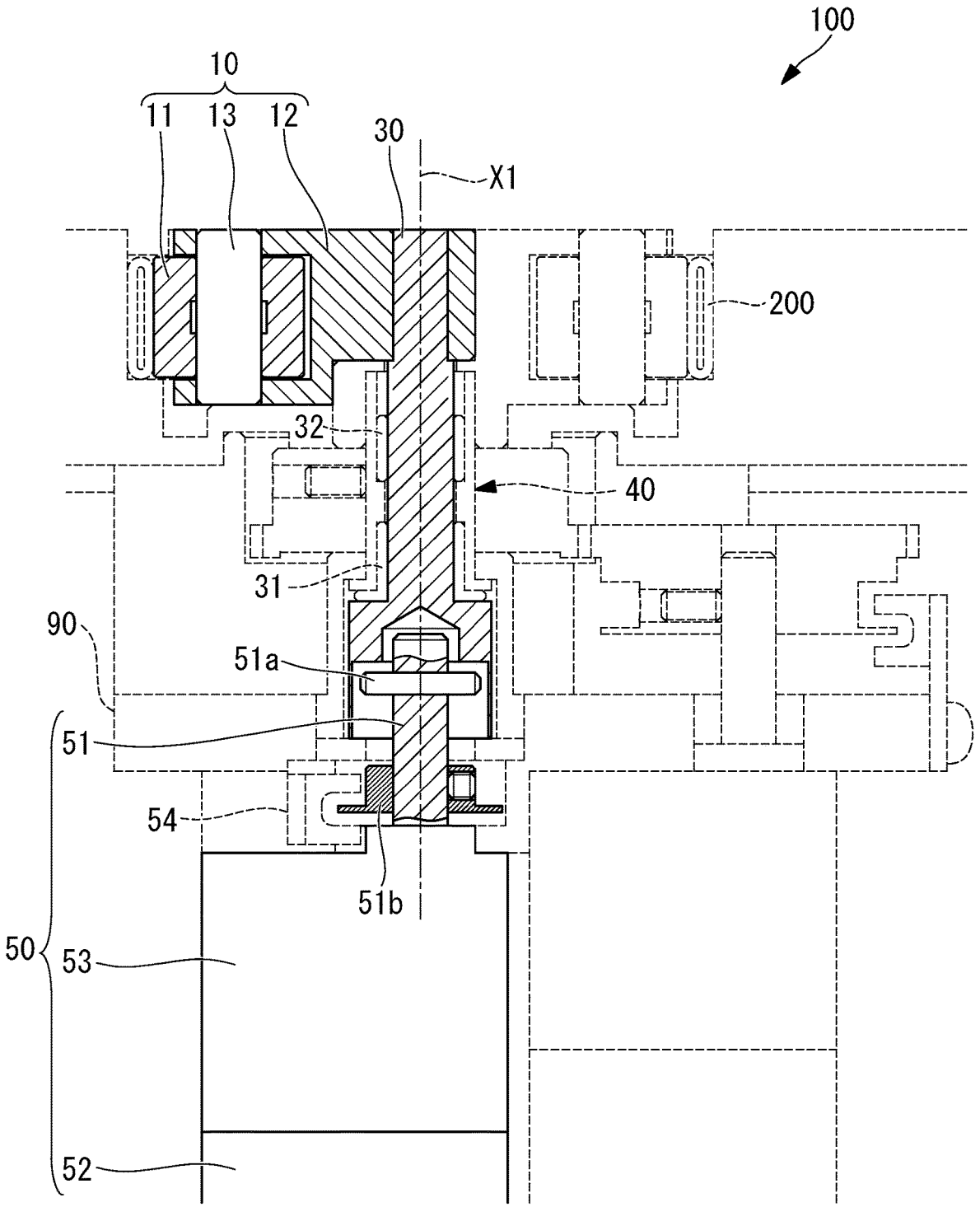
FIG. 3 is a longitudinal cross-sectional view illustrating a structure in which a first drive unit illustrated in FIG. 1 transmits a drive force to a first roller unit.

Next, with reference to FIG. 3, there will be explained a structure in which the first drive unit 50 transmits a drive force to the first roller unit 10. In FIG. 3, a portion shown by continuous lines is the portion included in the structure of transmitting a drive force of the first drive unit 50 to the first roller unit 10.

Figure 4:
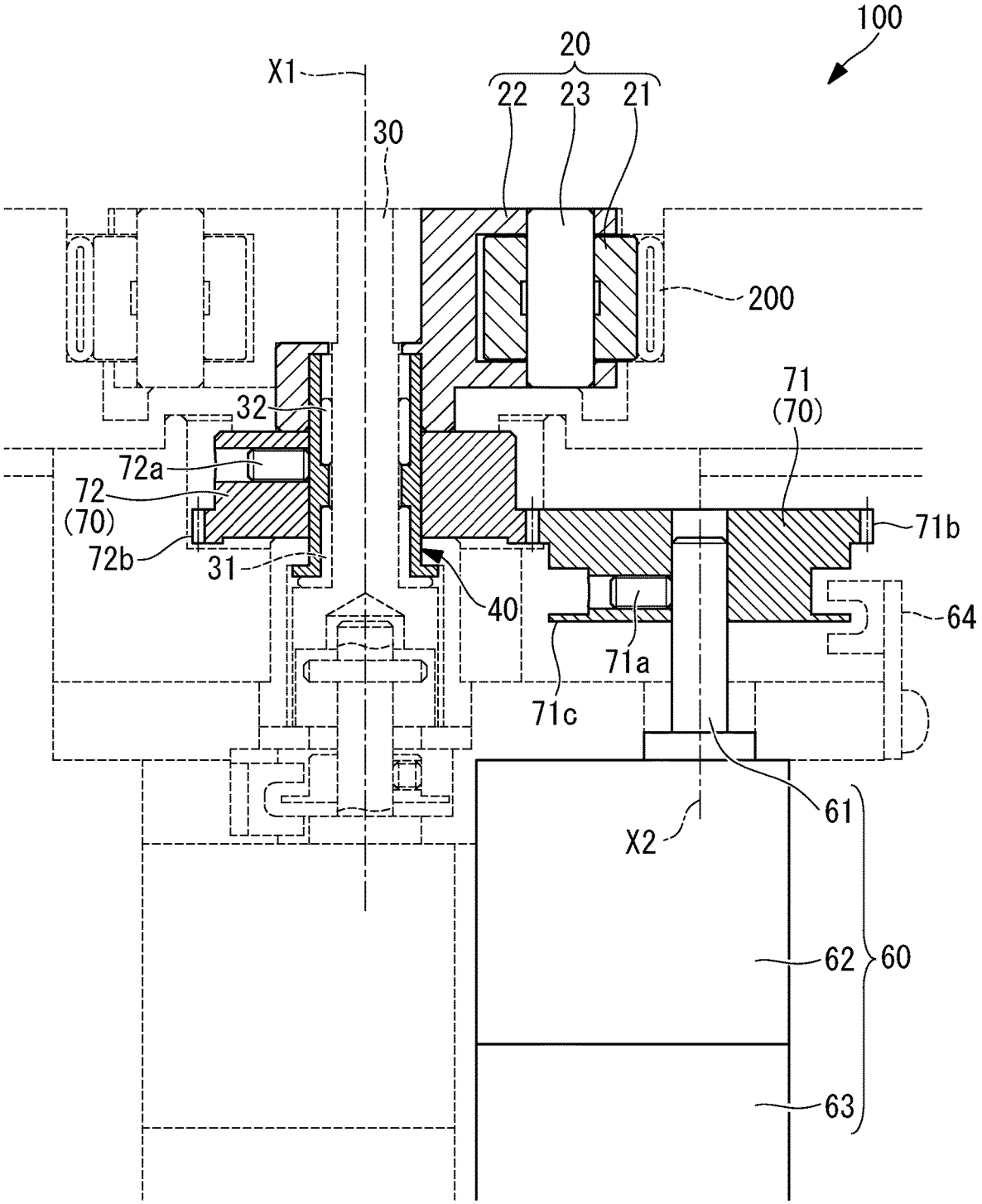
FIG. 4 is a longitudinal cross-sectional view illustrating a structure in which a second drive unit illustrated in FIG. 1 transmits a drive force to a second roller unit.

As shown in FIG. 4, the first drive unit 50 has the first drive shaft 51 that is arranged on the axis X1 and is coupled to the drive shaft 30. The first drive shaft 51 is attached to a lower end of the drive shaft 30 in a state where a pin 51*a* that extends in a direction perpendicular to the axis X1 is inserted into the first drive shaft 51. The drive shaft 30 is fixed to the first drive shaft 51 by the pin 51*a* so as not to relatively rotate around the axis X1. Therefore, when the first drive unit 50 rotates the first drive shaft 51 around the axis X1, a drive force of the first drive shaft 51 is transmitted to the drive shaft 30, and the drive shaft 30 rotates around the axis X1.

The first drive unit 50 has; the first drive shaft 51; the first electric motor 52; and a first reducer 53 that reduces a velocity of rotation of a rotation shaft (illustration is omitted) rotated by the first electric motor 52, and transmits the rotation to the first drive shaft 51. The first drive unit 50 rotates the first drive shaft 51 around the axis X1 by transmitting a drive force of the first electric motor 52 to the first drive shaft 51.

A position detecting member 51*b* that rotates around the axis X1 together with the first drive shaft 51 is attached to the first drive shaft 51. In the position detecting member 51*b*, in an annularly formed outer peripheral edge, a slit (illustration is omitted) for detecting a rotation position of the first roller unit 10 around the axis X1 is formed in a peripheral direction around the axis X1.

As shown in FIG. 3, a position detection sensor 54 is arranged so as to sandwich an upper surface and a lower surface of the outer peripheral edge of the position detecting member 51*b*. The position detection sensor 54 is the sensor in which a light-emitting element is arranged on one of an upper surface side and a lower surface side, and in which a light-receiving element is arranged on the other of the upper surface side and the lower surface side. The position detection sensor 54 detects a rotation position indicating which position the first roller unit 10 is arranged around the axis X1 by detecting by the light-receiving element through the slit that light emitted by the light-emitting element passes through in connection with the rotation of the position detecting member 51*b* around the axis X1, and transmits it to a control unit 400 (refer to FIG. 8).

The lower end of the drive shaft 30 is coupled to the first drive shaft 51. the drive shaft 30 is rotatably supported around the axis X1 on an inner peripheral side of the drive cylinder 40 by a cylindrical first bearing member 31 inserted along the outer peripheral surface, and a cylindrical second bearing member 32 formed independently from the first bearing member 31. As described above, in the drive shaft 30, the outer peripheral surface of a lower end side is supported by the first bearing member 31, and the outer peripheral surface of a central portion is supported by the second bearing member 32. Therefore, the drive shaft 30 smoothly rotates around the axis X1 in a state of holding a central axis on the axis X1.

The first roller support member 12 of the first roller unit 10 is coupled to the tip side of the drive shaft 30 so as to integrally rotate around the axis X1. As described above, the drive force by which the first drive unit 50 rotates the first drive shaft 51 around the axis X1 is transmitted from the first drive shaft 51 to the first roller unit 10 through the drive shaft 30.

Next, with reference to FIG. 4, there will be explained a structure in which the second drive unit 60 transmits a drive force to the second roller unit 20. In FIG. 4, a portion shown by continuous lines is the portion included in the structure of transmitting the drive force of the second drive unit 60 to the second roller unit 20. The structure shown in FIG. 4 has: the second roller unit 20; the drive cylinder 40; the second drive unit 60; and the transmission mechanism 70.

The transmission mechanism 70 shown in FIG. 4 has: a first gear unit 71 that rotates around the axis X2 (a second axis) parallel to the axis X1; and a second gear unit 72 to which a drive force of the second drive shaft 61 is transmitted from the first gear unit 71. The transmission mechanism 70 transmits the drive force of the second drive shaft 61 around the axis X2 to the outer peripheral surface of the drive cylinder 40, and rotates the drive cylinder 40 around the axis X1.

As shown in FIG. 4, the second drive unit 60 has; the second drive shaft 61 arranged on the axis X2; a second electric motor 62; and a second reducer 63 that reduces a velocity of rotation of a rotation shaft (illustration is omitted) rotated by the second electric motor 62, and transmits the rotation to the second drive shaft 61. The second drive unit 60 rotates the second drive shaft 61 around the axis X2 by transmitting a drive force of the second electric motor 62 to the second drive shaft 61.

The second drive shaft 61 is inserted into an insertion hole formed in a central portion of the first gear unit 71 formed in a cylindrical shape around the axis X2. The first gear unit 71 is fixed to the second drive shaft 61 by fastening a fixing screw 71*a* in a state where the second drive shaft 61 is inserted into the first gear unit 71, and making a tip of the fixing screw 71*a* abut against the second drive shaft 61. In a manner as described above, the first gear unit 71 is coupled to the second drive shaft 61, and rotates around the axis X2 together with the second drive shaft 61.

A first gear 71*b* of the first gear unit 71 formed around the axis X2 is engaged with a second gear 72*b* of the second gear unit 72 formed around the axis X1. Therefore, a drive force by rotation of the first gear unit 71 around the axis X2 is transmitted as the drive force that rotates the second gear unit 72 around the axis X1.

A position detecting member 71*c* that rotates around the axis X2 together with the second drive shaft 61 is formed at the first gear unit 71. In the position detecting member 71*c*, in an annularly formed outer peripheral edge, a slit (illustration is omitted) for detecting a rotation position of the second roller unit 20 around the axis X1 is formed in a peripheral direction around the axis X2.

As shown in FIG. 4, a position detection sensor 64 is arranged so as to sandwich an upper surface and a lower surface of an outer peripheral edge of the position detecting member 71*c*. The position detection sensor 64 is the sensor in which a light-emitting element is arranged on one of an upper surface side and a lower surface side, and in which a light-receiving element is arranged on the other of the upper surface side and the lower surface side. The position detection sensor 64 detects a rotation position indicating which position the second roller unit 20 is arranged around the axis X1 by detecting by the light-receiving element through the slit that light emitted by the light-emitting element passes through in connection with the rotation of the position detecting member 71*c* around the axis X2, and transmits it to the control unit 95 (refer to FIG. 8).

The drive cylinder 40 is inserted into an insertion hole formed in a central portion of the second gear unit 72 formed in a cylindrical shape around the axis X1. The insertion hole is a hole having an inner peripheral surface coupled to the outer peripheral surface of the drive cylinder 40. The second gear unit 72 is fixed to the drive cylinder 40 by fastening a fixing screw 72*a* in a state where the drive cylinder 40 is inserted into the second gear unit 72, and making a tip of the fixing screw 72*a* abut against the drive cylinder 40. In a manner as described above, the second gear unit 72 is coupled to the drive cylinder 40, and rotates around the axis X1 together with the drive cylinder 40.

As shown in FIG. 4, the drive cylinder 40 is arranged in a state of sandwiching the first bearing member 31 and the second bearing member 32 on an outer peripheral side of the drive shaft 30. Therefore, the drive cylinder 40 can be rotated around the axis X1 independently from the drive shaft 30. The drive shaft 30 rotates around the axis X1 by the drive force by the first drive unit 50, and the drive cylinder 40 rotates around the axis X1 by the drive force by the second drive unit 60 in a state of being independent from the drive shaft 30.

The second roller support member 22 of the second roller unit 20 is coupled to a tip side of the drive cylinder 40 so as to integrally rotate around the axis X1. As described above, the drive force by which the second drive unit 60 rotates the second drive shaft 61 around the axis X2 is transmitted to the outer peripheral surface of the drive cylinder 40 by the transmission mechanism 70, and is transmitted from the drive cylinder 40 to the second roller unit 20.

Figure 8:
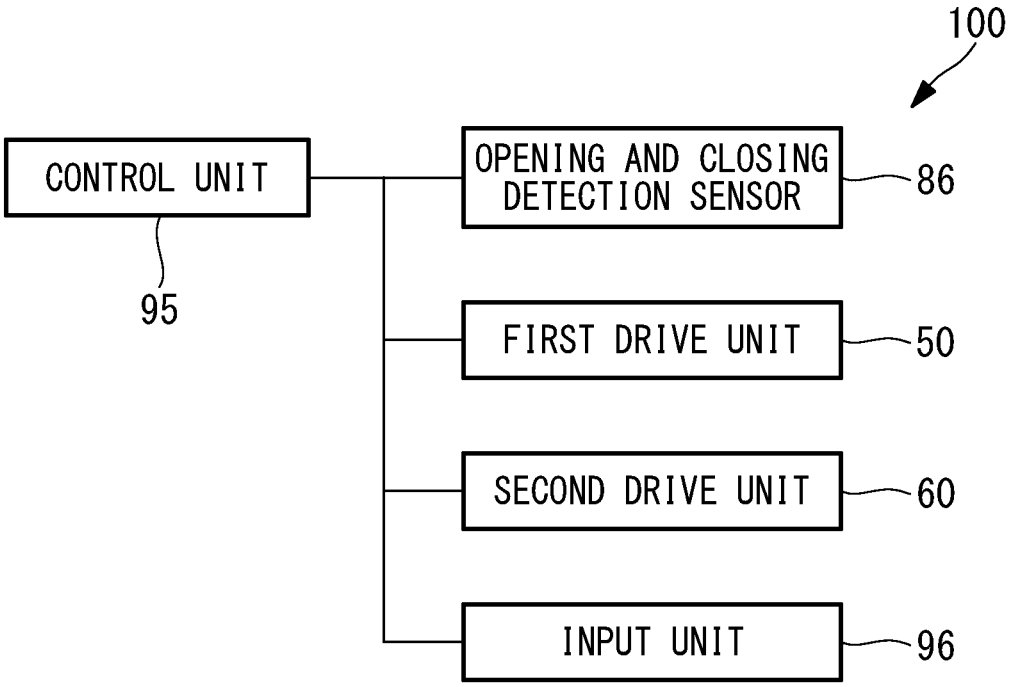
FIG. 8 is a block diagram illustrating a control configuration of the tube pump.

Next, a cover member 84 and a lid unit 85 included in the tube pump 100 according to the present embodiment will be described with reference to drawings. FIG. 5 is a plan view illustrating an embodiment of the tube pump 100 with the lid unit 85 in an opened state. FIG. 6 is a cross-sectional arrow view along II-II of the tube pump 100 illustrated in FIG. 5. FIG. 7 is a cross-sectional arrow view along II-II illustrating an embodiment of the tube pump 100 with the lid unit 85 in a closed state. FIG. 8 is a block diagram illustrating a control configuration of the tube pump.

As illustrated in FIGS. 5 and 6, the tube pump 100 according to the present embodiment includes the cover member 84 disposed in the recessed part 82*b* of the housing unit 82 and the lid unit 85 that can switch between opened and closed states.

The cover member 84 is a member that prevents an operator from touching the vicinity of the first roller unit 10 and the second roller unit 20 with hands and prevents fingers of the operator from getting caught between the first roller unit 10 and the second roller unit 20 in a case in which the lid unit 85 is in an opened state. Since each of the first roller unit 10 and the second roller unit 20 in the present embodiment can independently rotate about the axis X1, the rotation angle around the axis X1 between the first roller unit 10 and the second roller unit 20 is changed from a wide state to a narrow state. Thus, a trouble that fingers of the operator get caught is prevented by providing the cover member 84 in the present embodiment.

As illustrated in FIGS. 5 and 6, the cover member 84 is provided such that the first roller unit 10 and the second roller unit 20 are covered therewith and is fastened to the drive shaft 30 with a fastening screw 84*a*. The cover member 84 is a member formed to have a circular plan view of a radius R1 around the axis X1, which passes through the center of the drive shaft 30, at the center. In FIGS. 5 and 6, the arc-shaped inner peripheral surface 82*a* along which the tube 200 is disposed is a surface disposed along a circle with a radius R2 around the axis X1 at the center.

As illustrated in FIG. 5, a region from the radius R1 to the radius R2 around the axis X1 at the center is an annular opening region OA. The tube pump 100 illustrated in FIG. 5 is illustrated in a retreating state in which the rotation angle around the axis X1 between the first roller unit 10 and the second roller unit 20 is fixed and both the first roller unit 10 and the second roller unit 20 are not in contact with the tube 200.

As illustrated in FIG. 5, the tube 200 in a natural state, with which the first roller unit 10 and the second roller unit 20 do not come into contact, has an outer diameter D1. The outer diameter D1 is smaller than a difference obtained by subtracting the radius R1 from the radius R2. The tube 200 can thus be inserted into the opening region OA toward the inner peripheral surface 82*a*.

As illustrated in FIG. 5, the distance (the radius around the axis X1 at the center) from tip ends of the first roller unit 10 and the second roller unit 20 to the axis X1 is a radius R3. The radius R3 is larger than the radius R1 and is smaller than the radius R2. Therefore, the tip ends of the first roller unit 10 and the second roller unit 20 pass through the opening region OA when the first roller unit 10 and the second roller unit 20 rotate about the axis X1. In this manner, it is possible for the operator to easily visually recognize the positions of the tip ends of the first roller unit 10 and the second roller unit 20 even in the case in which the cover member 84 is attached.

As illustrated in FIG. 5, the cover member 84 is disposed in the recessed part 82*b* of the housing unit 82 such that the first roller shaft 13 and the second roller shaft 23 are covered therewith. Even if the first roller 11 and the second roller 21 approach or come into contact with each other in the rotation direction around the axis X1, the first roller 11 and the second roller 21 approach or come into contact with each other in the region covered with the cover member 84. It is thus possible to prevent a trouble that fingers of the operator get caught due to the approaching or the contact of the first roller 11 and the second roller 21.

Here, it is desirable that the cover member 84 be formed of a light transmitting material such that the operator can visually recognize the rotation positions of the first roller unit 10 and the second roller unit 20 around the axis X1. The light transmitting material is, for example, a resin material such as polycarbonate. It is possible for the operator to easily find a trouble that a foreign matter gets caught between the first roller unit 10 and the second roller unit 20 and abnormality in operations of the first roller unit 10 and the second roller unit 20, by forming the cover member 84 using the light transmitting material.

Although the cover member 84 is formed of the light transmitting material here, another aspect may be employed. For example, a plurality of notch portions (not illustrated) with a narrower width than an opening width (radius R2–radius R1) of the opening region OA may be formed in the cover member 84. According to such a cover member 84, the forming of the plurality of notch portions enables the operator to visually recognize the rotation positions of the first roller unit 10 and the second roller unit 20.

Also, since the notch portions have a narrower width than the opening width (radius R2–radius R1) of the opening region OA, it is possible to prevent a trouble that fingers of the operator get caught between the first roller unit 10 and the second roller unit 20. It is possible to employ notch portions with various shapes, for example, notch portions radially formed around the axis X1 at the center or notch portions formed in an arc shape around the axis X1 at the center.

As illustrated in FIGS. 6 and 7, the lid unit 85 is a member that can switch between a closed state in which the lid unit 85 covers an entire region (the region of the radius R2 around the axis X1 at the center) of the recessed part 82*b* of the housing unit 82 and an opened state in which the lid unit 85 is separated from the recessed part 82*b*. The lid unit 85 includes coupling portions 85*a* coupled to the housing unit 82, a recessed portion 85*b* that accommodates the cover member 84 in the closed state, a projecting portion 85*c* that is formed in an annular shape such that the projecting portion 85*c* projects toward the recessed part 82*b* of the housing unit 82 in the closed state, and a magnet 85*d* for detecting the opened and closed states of the lid unit 85.

As illustrated in FIG. 6, the lid unit 85 is coupled to the housing unit 82 with the pair of coupling portions 85*a*. The lid unit 85 can swing around an axis Y1 at which the pair of coupling portions 85*a* are disposed. The operator switches the lid unit 85 into the opened state by gripping a tip end portion 84*e* of the lid unit 85 in the closed state and lifting the lid unit 85 upward to cause the lid unit 85 to swing around the axis Y1.

As illustrated in FIG. 7, the projecting portion 85*c* is disposed in an annular shape such that the projecting portion 85*c* comes into contact with the tube 200 disposed along the inner peripheral surface 82*a* of the housing unit 82 in a case in which the lid unit 85 is brought into the closed state. The projecting portion 85*c* forms, along with the recessed part 82*b*, a groove portion that has a bottom portion formed by the inner peripheral surface 82*a* and extends in the circumferential direction around the axis X1. Since a state in which the tube 200 is accommodated in the groove portion is achieved in a case in which the lid unit 85 is brought into the closed state, it is possible to appropriately perform ejection of a liquid using the first roller unit 10 and the second roller unit 20.

As illustrated in FIG. 6, the tube pump 100 according to the present embodiment includes an opening and closing detection sensor (detection unit) 86 that detects the opened and closed states of the lid unit 15. The opening and closing detection sensor 86 is a sensor that is brought into an ON state in a case in which the magnet 85*d* included in the lid unit 85 is disposed at a close position (the position illustrated in FIG. 7) and is brought into an OFF state in a case in which the magnet 85*d* is disposed at a separated position (a position that is different from the position illustrated in FIG. 7).

The opening and closing detection sensor 86 preferably includes a magnet or a magnetic element that generates a magnetic force for attracting the magnet 85*d* included in the lid unit 85. A state in which the tip end portion 85*e* is in close contact with the housing unit 82 is maintained by the opening and closing detection sensor 86 attracting the magnet 85*d* of the lid unit 85 as long as the tip end portion 85*e* is not lifted with a force exceeding an attracting force of the magnet 85*d* attracting the opening and closing detection sensor 86.

As illustrated in FIG. 8, the tube pump 100 according to the present embodiment includes the control unit 95 that controls the first drive unit 50 and the second drive unit 60 and an input unit 96 through which the operator inputs an operation instruction to the tube pump 100. The control unit 95 performs control such that the first drive unit 50 and the second drive unit 60 are stopped in a case in which the opening and closing detection sensor 86 detects that the lid unit 85 is in the opened state and a signal indicating the opened state is transmitted from the opening and closing detection sensor 86.

Since the operator brings the lid unit 85 into the opened state to perform replacement or the like of the tube 200, there is a probability that fingers of the operator get caught between the first roller unit 10 and the second roller unit 20 if the first drive unit 50 and the second drive unit 60 are maintained to operate. In the present embodiment, the first drive unit 50 and the second drive unit 60 are stopped in a case in which the lid unit 85 is in the opened state, and it is thus possible to prevent the trouble that fingers of the operator get caught between the first roller unit 10 and the second roller unit 20.

Note that the tube pump 100 according to the embodiment includes the cover member 84 disposed in the recessed part 82*b* such that the cover member 84 covers the first roller unit 10 and the second roller unit 20. Therefore, it is possible to prevent the trouble that fingers of the operator get caught between the first roller unit 10 and the second roller unit 20 even in a case in which the first roller unit 10 and the second roller unit 20 has still not been stopped immediately after the lid unit 85 is brought into the opened state from the closed state or a case in which some error operation has occurred.

Although the tube pump 100 includes the opening and closing detection sensor 86 and the first drive unit 50 and the second drive unit 60 are stopped in a case in which the lid unit 85 is in the opened state in the above description, another aspect may be employed. For example, the tube pump 100 may not include the opening and closing detection sensor 86, and the first drive unit 50 and the second drive unit 60 may not be stopped even in a case in which the lid unit 85 is in the opened state. Even in this case, it is possible to prevent the trouble that fingers of the operator get caught between the first roller unit 10 and the second roller unit 20 since the tube pump 100 includes the cover member 84.

The tube pump 100 according to the present embodiment can execute an ejection control mode (first control mode) in which the first roller unit 10 and the second roller unit 20 are caused to rotate in the same direction to eject the fluid in the tube 200 using the first roller unit 10 and the second roller unit 20, by the control unit 95 controlling the first drive unit 50 and the second drive unit 60.

In a case in which the ejection control mode is executed, the operator sets, via the input unit 96, the flow amount per unit time of the liquid to be ejected by the tube pump 100 to the flowing-out side 200*b*. The control unit 95 controls the first drive unit 50 and the second drive unit 60 such that the set flow amount of liquid is ejected to the flowing-out side 200*b*.

Also, the tube pump 100 according to the present embodiment can execute a tube replacement mode (second control mode) in which the rotation angles of each of the first roller unit 10 and the second roller unit 20 is fixed such that the first roller unit 10 and the second roller unit 20 do not come into contact with the tube 200, by the control unit 95 controlling the first drive unit 50 and the second drive unit 60.

In a case in which the tube replacement mode is executed, the operator provides an instruction for executing the tube replacement mode via the input unit 96. The control unit 95 fixes the rotation angle of each of the first roller unit 10 and the second roller unit 20 such that the first roller unit 10 and the second roller unit 20 do not come into contact with the tube 200 as illustrated in FIG. 5.

Figure 9:
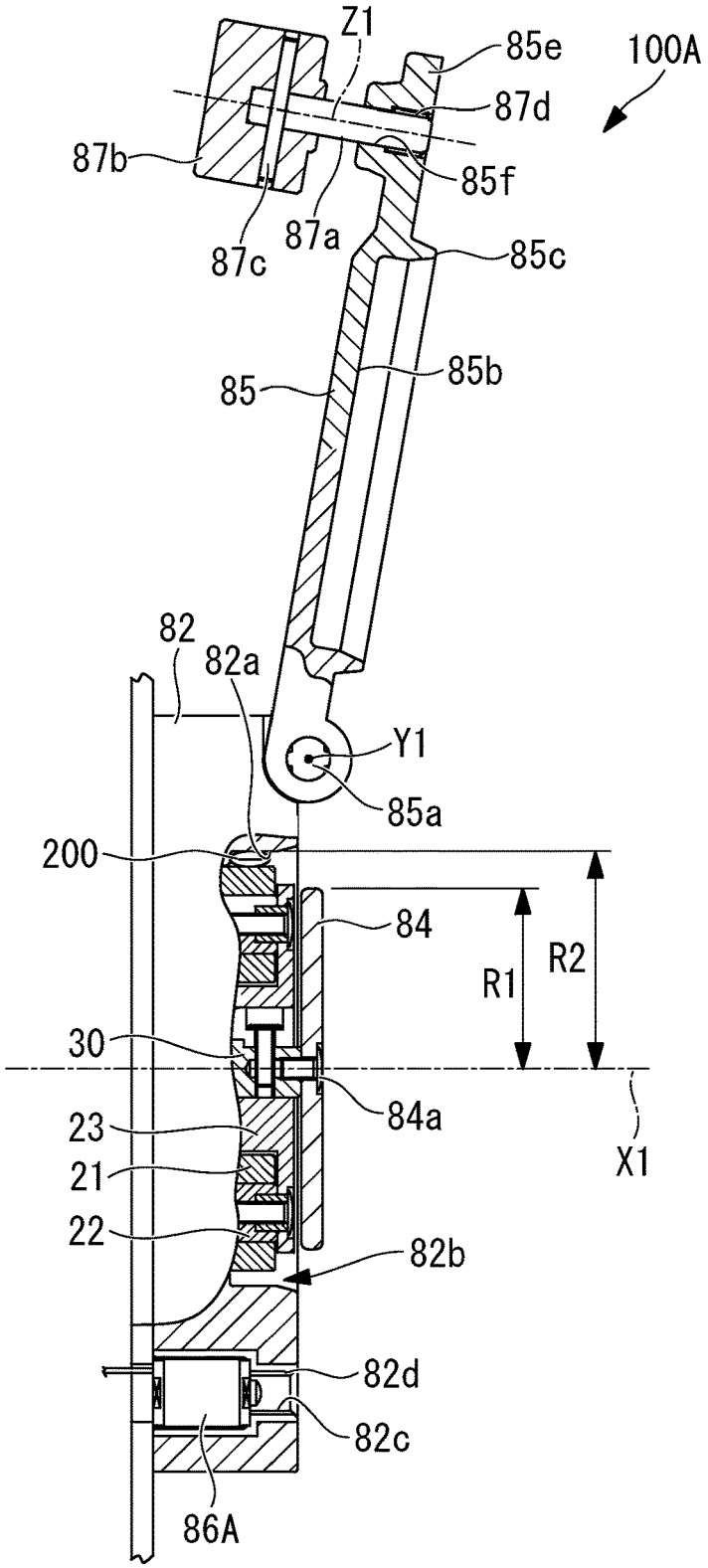
FIG. 9 is a longitudinal cross-sectional view illustrating a tube pump according to a modification with a lid unit in an opened state.
Figure 10:
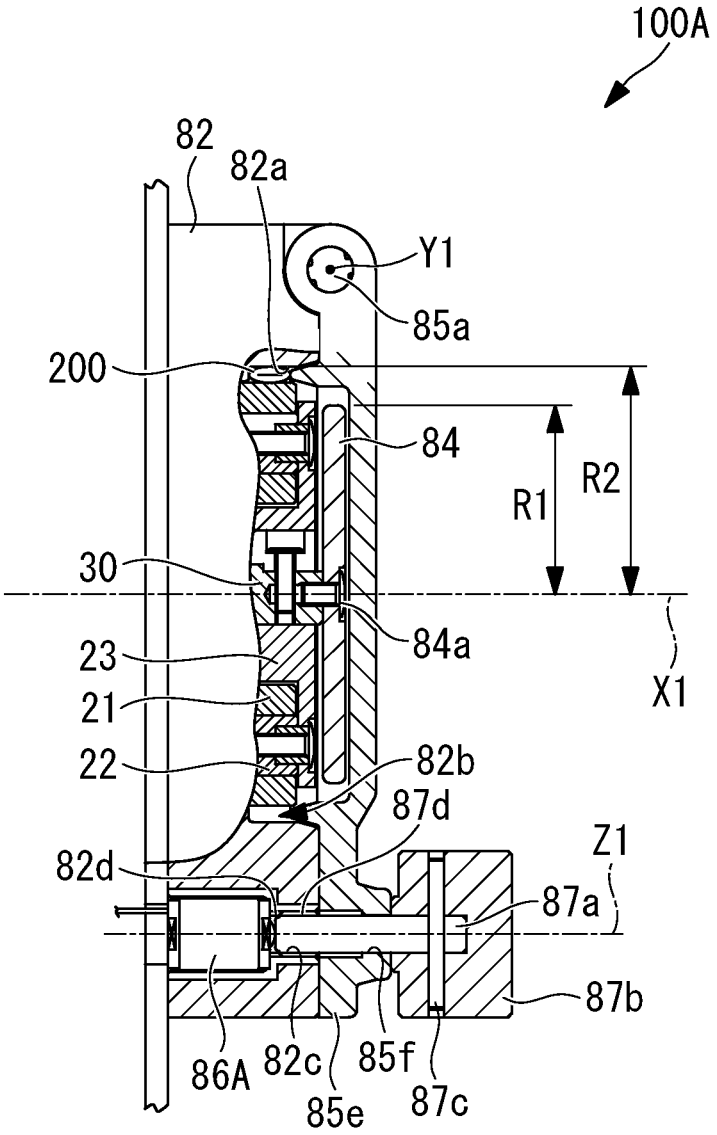
FIG. 10 is a longitudinal cross-sectional view illustrating the tube pump according to the modification with the lid unit in a closed state.

Although the tube pump 100 according to the present embodiment is adapted such that the opening and closing detection sensor 86 detects the opened state by the magnet 85*d* provided at the lid unit 85 being disposed at a close position, another aspect may be employed. For example, a tube pump 100A according to a modification as illustrated in FIGS. 9 and 10 may be employed. FIG. 9 is a longitudinal cross-sectional view illustrating the tube pump 100A according to the modification with the lid unit 85 in the opened state. FIG. 10 is a longitudinal cross-sectional view illustrating the tube pump 10A according to the modification with the lid unit 85 in the closed state.

As illustrated in FIGS. 9 and 10, the tube pump 100A includes a locking mechanism 87 attached in the vicinity of the tip end portion 85*e* of the lid unit 85. The locking mechanism 87 is a mechanism that fixes the lid unit 85 to the housing unit 82 such that the closed state is maintained. The locking mechanism 87 includes an axial portion 87*a* extending along an axis Z1, a knob portion 87*b* attached to one end of the axial portion 87*a*, and a stopper pin 87*c* that fixes the knob portion 87*b* in order to prevent the knob portion 87*b* from rotating about the axis Z1 with respect to the axial portion 87*a*.

An end portion of the axial portion 87*a* on the side of the lid unit 85 is inserted into a through hole 85*f* formed in the lid unit 85. A male screw portion 87*d* is formed at the end portion of the axial portion 87*a* on the side of the lid unit 85. The male screw portion 87*d* rotates about the axis Z1 by the operator rotating the knob portion 87*b* about the axis Z1. As illustrated in FIG. 9, the housing unit 82 is provided with an opening and closing detection sensor 86A, and a through hole 82*c* is formed from the opening and closing detection sensor 86A toward the surface of the housing unit 82. A female screw portion 82*d* is formed in the inner peripheral surface of the through hole 82*c*.

The operator can achieve the closed state illustrated in FIG. 10 in which the lid unit 85 has approached the housing unit 82, by gripping the tip end portion 85*e* of the lid unit 85 illustrated in FIG. 9 and pulling the lid unit 85 downward to cause the lid unit 85 to swing around the axis Y1. The operator causes the axial portion 87*a* to rotate about the axis Z1 by causing the knob portion 87*b* to rotate about the axis Z1 and then causes the male screw portion 87*d* to be engaged with the female screw portion 82*d*. By the male screw portion 87*d* being engaged with the female screw portion 82*d*, the lid unit 85 is fixed to the housing unit 82 such that the closed state is maintained.

The operator brings the tip end of the axial portion 87*a* into contact with the opening and closing detection sensor 86A by causing the knob portion 87*b* to further rotate about the axis Z1 in the state in which the lid unit 85 is fixed to the housing unit 82. If the tip end of the axial portion 87*a* comes into contact with the opening and closing detection sensor 86A, then the opening and closing detection sensor 86A is brought into the ON state and detects that the lid unit 85 is in the closed state. In a case in which the tip end of the axial portion 87*a* does not come into contact with the opening and closing detection sensor 86A, the opening and closing detection sensor 86A is brought into the OFF state and detects that the lid unit 85 is in the opened state.

Effects and advantages that the tube pump 100 according to the present embodiment as described above exhibits will be described.

Since the tube pump 100 according to the present embodiment includes the first roller unit 10 and the second roller unit 20 and the first drive unit 50 and the second drive unit 60 that cause he first roller unit 10 and the second roller unit 20 to rotate about the axis X1 in the same direction, respectively, it is possible to cause the first roller unit 10 and the second roller unit 20 that rotate in contact with the tube 200 held in an arc shape around the axis X1 by the housing unit 82 to independently rotate about the axis X1. Also, according to the tube pump 100 of the present embodiment, the cover member 84 is disposed in the housing unit 82 such that the cover member 84 provides the annular opening region OA into which the tube 200 can be inserted toward the inner peripheral surface 82*a*. It is thus possible to prevent fingers of the operator from getting caught between the first roller unit 10 and the second roller unit 20. Also, since the tube 200 can be inserted from the opening region OA toward the inner peripheral surface 82*a* of the housing unit 82, the operator can easily replace the tube 200.

According to the tube pump 100 of the present embodiment, the cover member 84 is disposed in the housing unit 82 such that the cover member 84 covers the first roller shaft 13 and the second roller shaft 23. The first roller 11 and the second roller 21 approach or come into contact with each other in the region covered with the cover member 84 even if the first roller 11 and the second roller 21 attached to the first roller shaft 13 and the second roller shaft 23 approach or come into contact with each other in the rotation direction around the axis X1. It is thus possible to prevent the trouble that fingers of the operator get caught due to the approaching or the contact of the first roller 11 and the second roller 21.

According to the tube pump 100 of the present embodiment, it is possible to visually recognize the rotation positions of the first roller unit 10 and the second roller unit 20 around the axis X1 regardless of the disposition of the cover member 84, and it is thus possible for the operator to easily find a trouble that a foreign matter gets caught between the first roller unit 10 and the second roller unit 20 or a trouble in operations of the first roller unit 10 and the second roller unit 20. The cover member 84 is preferably formed of a light transmitting material. Also, the plurality of notch portions with a narrower width than the opening width of the opening region OA, for example, are preferably formed in the cover member 84.

According to the tube pump 100 of the present embodiment, the lid unit 85 in the closed state covers the entire region of the recessed part 82*b*, and it is thus possible to reliably prevent the operator from accidentally touching the vicinity of the first roller unit 10 and the second roller unit 20 with hands and to prevent a trouble that fingers get caught due to the accidental touch. Also, since the first drive unit 50 and the second drive unit 60 are stopped in a case in which the opening and closing detection sensor 86 detects that the lid unit 85 is in the opened state, the first roller unit 10 and the second roller unit 20 do not rotate about the axis X1 in a state in which the operator can touch the vicinity of the first roller unit 10 and the second roller unit 20. It is thus possible to prevent fingers of the operator from getting caught between the first roller unit 10 and the second roller unit 20.

According to the tube pump 100 of the present embodiment, both the first roller unit 10 and the second roller unit 20 can be disposed at retreating positions at which the first roller unit 10 and the second roller unit 20 do not come into contact with the tube 200 by the control unit 95 executing the tube replacement mode. It is possible to easily replace the tube in use with another tube by disposing the first roller unit 10 and the second roller unit 20 at the retreating positions.

While example embodiments have been particularly shown and described, it will be understood by those skilled in the art that various changes in form and details may be made therein without departing from the scope of the embodiments encompassed by the appended claims.

What is claimed is:

1. A tube pump comprising:

a tube with flexibility, a housing unit that has an inner peripheral surface, which is formed in an arc shape around an axis, along which the tube is disposed, and that is opened toward one end side along the axis;

a pair of roller units that are accommodated in the housing unit and rotate about the axis in a state in which the tube is blocked;

a pair of drive units that cause each of the pair of roller units to rotate about the axis in the same direction;

a cover member that is disposed in the housing unit such that the cover member covers the pair of roller units and provides an annular opening region into which the tube is able to be inserted toward the inner peripheral surface, the cover member being a member formed to have a circular plan view of a first radius around the axis; and a lid unit that is able to switch between a closed state in which the housing unit is covered and an opened state in which the lid unit is separated from the housing unit, the lid unit including a recessed portion that accommodates the cover member in the closed state and a projecting portion that is formed in an annular shape such that the projecting portion projects toward the opening region, wherein the inner peripheral surface is an arc-shaped surface disposed along a circle with a second radius around the axis, the tube being disposed along the inner peripheral surface, the second radius being larger than the first radius, an outer diameter of the tube in a natural state is smaller than a difference obtained by subtracting the first radius from the second radius, the pair of roller units do not come into contact with the tube in the natural state, the annular opening region having an opening width same as the difference obtained by subtracting the first radius from the second radius around an entire annular opening region except for a tubing entrance part and a tubing exit part, and the projecting portion extends in the annular opening region along the inner peripheral surface of the housing unit in a case in which the lid unit is brought into the closed state so as to cooperate with the housing unit to form a groove portion that accommodates the tube.

2. The tube pump according to claim 1, wherein the pair of roller units have a pair of rollers that come into contact with the tube, a pair of roller support members that are coupled to the pair of drive units and rotate about the axis while supporting the pair of rollers, and a pair of roller shafts, which have both end portions supported by the roller support members, to which the rollers are rotatably attached, and the cover member is disposed in the housing unit such that the cover member covers the pair of roller shafts.

3. The tube pump according to claim 1, the tube pump further comprises:

a detection unit that detects the opened and closed states of the lid unit; and a control unit that controls each of the pair of drive units, and the control unit performs control such that the pair of drive units are stopped in a case in which the detection unit detects that the lid unit is in the opened state.

4. The tube pump according to claim 3, wherein the control unit is able to execute a first control mode in which the pair of roller units are caused to rotate in the same direction to eject a liquid in the tube and a second control mode in which a rotation angle of each of the pair of roller units is fixed such that the pair of roller units do not come into contact with the tube, wherein in the second control mode, tip ends of the pair of roller units are disposed in the annular opening region between the tubing entrance part and the tubing exit part; and wherein the cover member is formed of a light transmitting material and is disposed in the housing unit such that rotation positions of the pair of roller units around the axis are visually recognizable against the cover member in the second control mode, the entire area of the pair of the roller units except for the tip ends being covered by the cover member.

5. The tube pump according to claim 1, further comprising:

a drive shaft that is coupled to one of the pair of roller units;

a drive cylinder that is coupled to the other of the pair of roller units, the drive cylinder being arranged on an outer peripheral side of the drive shaft to be rotatable about the axis independently of the drive shaft, wherein one of the pair of the drive units rotates the drive shaft around the axis in a predetermined direction, the other of the pair of the drive units rotates the drive cylinder around the axis in the predetermined direction, and the cover member is removably attached to the drive shaft.

* * * * *